US005718101A

United States Patent [19]

Noel et al.

[11] Patent Number: 5,718,101

[45] Date of Patent: Feb. 17, 1998

[54] METHOD AND APPARATUS FOR PACKAGING A PRODUCT IN A DUAL-LID PACKAGE

[75] Inventors: David Christopher Noel, Greer; James Randall Mabry, Spartanburg, both of S.C.

[73] Assignee: W. R. Grace & Co.-Conn., Duncan, S.C.

[21] Appl. No.: 660,327

[22] Filed: Jun. 4, 1996

[51] Int. Cl.[6] ..... B65B 53/02; B65B 7/28; B65B 31/02

[52] U.S. Cl. ..... 53/432; 53/442; 53/478; 53/485; 53/510; 53/557; 53/329.3; 53/329.5; 53/300

[58] Field of Search ..... 53/442, 453, 471, 53/478, 485, 432, 510, 557, 282, 281, 300, 329.3, 329.5; 426/106, 396

[56] References Cited

U.S. PATENT DOCUMENTS 3,383,256 5/1968 Carbone ..... 53/329.3 X
3,426,504 2/1969 Christensson ..... 53/329.3 X
4,811,550 3/1989 Hautemont ..... 53/329.3 X

*Primary Examiner*—Linda Johnson
*Attorney, Agent, or Firm*—Thomas C. Lagaly

[57] ABSTRACT

A method and apparatus for enclosing a product in a tray having an outwardly extending flange is provided. A permeable web is secured to an inner periphery of flange and the secured portion is severed from the web to form a permeable lid. An impermeable web is then secured to an outer periphery of the flange and then severed from the web to form a peelable, impermeable lid. The outer periphery of the flange is protected from damage when the permeable lid is severed from the permeable web by elevating the permeable web above the outer periphery of the flange and severing the web at the elevated portion.

If a fresh red meat product is to be packaged, the tray may be at least partially evacuated and then at least partially filled with a gas which is lower in oxygen content than air. Prior to retail sale, the impermeable lid may be removed to cause the packaged meat product to bloom to a red color.

18 Claims, 5 Drawing Sheets

METHOD AND APPARATUS FOR PACKAGING A PRODUCT IN A DUAL-LID PACKAGE

BACKGROUND OF THE INVENTION

The present invention relates to packaging for products, such as food products, which are enclosed under certain environmental conditions in a support member having two lids, one being more oxygen permeable than the other, such that removal of one of the lids causes a change in the environmental conditions within the package. More specifically, the invention relates to an improved method and apparatus for making such a package.

Historically, large sub-primal cuts of meat have been butchered and packaged in each supermarket. This arrangement has long been recognized to be inefficient and expensive. It would instead be preferable to butcher and package the meat at a central processing facility which benefits from economies of scale, and then ship the packaged meat to individual supermarkets or other retail outlets such as is done, for example, with many poultry products.

Fresh red meat presents a particular challenge to the concept of centralized processing and packaging due to its oxygen-sensitivity. Such oxygen-sensitivity is manifested in the shelf-life and appearance (color) of a packaged meat product. For example, while a low-oxygen packaging environment generally increases the shelf-life of a packaged meat product (relative to a meat product packaged in an environment having a higher oxygen content), red meat has a tendency to assume a purple color when packaged in the absence of oxygen or in an environment having a very low oxygen concentration, i.e., below about 5% oxygen. Unfortunately, such a purple color is undesirable to most consumers, and marketing efforts to teach the consumer about the harmlessness of the purple color have been largely ineffective. When meat is exposed to a sufficiently high concentration of oxygen, e.g., as found in air, it assumes a bright red color which most consumers associate with freshness. After 1 to 3 days of such exposure, however, meat assumes a brown color which, like the purple color, is undesirable to most consumers.

Thus, in order to effectively butcher and package meat products in a central facility for distribution to retail outlets, the meat would desirably be packaged, shipped, and stored in a low-oxygen environment for extended shelf-life, and then displayed for consumer sale in a relatively high-oxygen environment such that the meat is caused to "bloom" into a red color just before being placed in a retail display case. While in the retail display case, the meat product is desirably contained in a package which protects it from dirt and microbial contamination. In order to attain the maximum economic benefit from centralized packaging, the package in which the meat product is displayed for consumer sale is the same package in which the meat product is initially packaged and shipped from the central processing facility. As can be appreciated, centralized butchering and packaging of fresh red meat presents a number of difficult packaging challenges.

A variety of packages have been developed in an effort to overcome the foregoing challenges. One attempted solution is to use a dual layer cover or lid over a support member, such as an oxygen-barrier tray, which contains the meat product. The upper lid is oxygen impermeable, i.e., provides a substantial barrier to the passage of oxygen therethrough, and may be removed to expose a lower lid that is relatively oxygen permeable, i.e., sufficiently permeable to the passage of oxygen to allow the packaged meat product to bloom. Thus, the package may be shipped with the upper lid intact so that a low-oxygen environment may be maintained within the package during shipping. Then the upper lid may be removed at the supermarket just prior to placing the package in a retail display case. Since the lower lid is oxygen permeable, it allows the meat product to bloom in the presence of oxygen which enters the package from the ambient atmosphere.

Conventional dual-lid packaging schemes can employ either a single, peelable film which delaminates into permeable and impermeable portions, or separate, discrete permeable and impermeable films. While peelable films have the advantage of providing a single web for sealing to a conventional tray flange, such films often fail during peeling, with the impermeable portion either being difficult to delaminate from the permeable portion or with all or part of the permeable portion remaining bonded to the impermeable portion and tearing away from the rest of the package, thereby resulting in tears or pinholes in the package which expose the packaged meat product to dirt or contamination.

With the discrete, dual film approach, the permeable and impermeable films are typically sealed to separate locations on the tray flange, with the permeable film being sealed to an inner periphery of the flange and the impermeable film being sealed to an outer periphery of the flange, i.e., outboard of the flange area at which the permeable film is sealed. One drawback of this approach is the difficulty of sealing two separate lids to a conventional, single-flange tray in an automated fashion, i.e., continuously from separate permeable and impermeable webs of film. The permeable lid must be applied to the tray flange from a continuous web, secured (e.g., heat-sealed) to an inner periphery of the flange, and then severed from the web in such a manner as to leave a sufficient area on an outer periphery of the flange to which the impermeable lid can be secured and severed from a continuous web of an impermeable film.

The primary difficulty in performing the foregoing procedure arises in the step of severing the permeable lid from the permeable web. Severing is generally accomplished with a sharp cutting instrument or with a heated wire or other heated element, and must be performed in such a manner as to avoid damaging the outer periphery of the flange. Trays used in dual-lid packaging must provide a barrier to the entry of oxygen, either by being formed from an oxygen-impermeable material or, more commonly, by having an oxygen-impermeable film conformally laminated to the inside of an otherwise oxygen-permeable tray, thereby forming an oxygen-barrier liner for the tray. When the flange is damaged, e.g., punctured, scorched, or melted, oxygen can enter the package prematurely, i.e., during shipment or storage, thereby resulting in shortened shelf-life and a packaged meat product which may be brown in color at the time it is desired to place it in a retail display case (thereby rendering the meat product effectively unsaleable). Another consequence of a damaged tray flange is that, in the case where the tray has an oxygen-barrier liner, the liner often delaminates from the tray when an attempt is made to peel the upper, oxygen-impermeable lid from the tray prior to retail sale. When this occurs, the meat product must be repackaged.

In addition to foregoing functional problems, a damaged tray flange is also aesthetically unappealing to the consumer.

Since the permeable web lies flat on the flange during the severing operation, it is difficult to avoid damaging the flange, e.g., by cutting into the flange or scorching, burning, or melting the flange, while severing the permeable lid from the permeable web.

A potential solution to this problem is disclosed in U.S. Pat. Nos. 5,348,752 and 5,439,132, both of which are issued to World Class Packaging Systems, Inc. Those patents disclose dual-lid packages as described above, wherein the tray flange has two separate sealing surfaces to which permeable and impermeable lids can be separately attached. In one embodiment, the sealing surfaces comprise inboard and outboard ledges which are separated by a trough or depression to facilitate the severing of the permeable cover from a permeable web. The permeable web is secured to the inboard ledge and then severed by moving a cutting press downwardly through the web and into the trough. The impermeable web is then be sealed to the outboard ledge and severed. In another embodiment, the inboard sealing surface is a ledge surrounded by a recessed lip, the recessed lip serving as the outboard sealing surface. The permeable web is secured to the ledge and then severed by moving a cutting press downwardly through the web at a position radially outward from the ledge as permitted by the recessed lip. The impermeable web is then be sealed to the outboard recessed lip and severed.

While this approach provides a workable solution to the problem of damaging the outer periphery of the flange while severing the permeable lid from the permeable web, it still presents difficulties when carried out in an automated process because it requires a very close tolerance between the severing device and the trough or recessed lip. The tolerance is particularly tight when the severing device is a heated element or wire. Such tight tolerances are difficult to attain on a consistent and continuous basis and can result in an unacceptably high occurrence of damaged flanges. In addition, trays having two separate sealing surfaces are more costly to manufacture than conventional single flange trays and also present an unfamiliar appearance to the consumer.

Accordingly, a need still remains in the art for a method and apparatus for packaging a product in a dual-lid package which allows for a simple tray-flange configuration and which provides a reliable way of severing the permeable web without causing damage to the outer periphery of the flange.

SUMMARY OF THE INVENTION

That need is met by the present invention which provides a method for packaging a product, comprising:

a. providing a tray with a product therein, the tray having an outwardly extending flange around substantially the entire perimeter of the tray;

b. positioning a web of material over the tray and securing a portion of the web to an inner periphery of the flange to substantially completely enclose the product between the tray and the secured portion of the web;

c. elevating a portion of the web, the elevated portion being located adjacent the secured portion such that the elevated portion is positioned above an outer periphery of the flange; and d. severing the web at the elevated portion, thereby separating the secured portion from the remainder of the web.

If a fresh red meat product is to be packaged, it is preferred that the method further include, prior to securing the web to the flange, the step of at least partially evacuating the tray of air and then at least partially filling the tray with a gas which is lower in oxygen content than air. Thereafter, it is preferred to include the steps of:

positioning a second web of material over the tray and securing a portion of the second web to the outer periphery of the flange; and severing the secured portion of the second web from the remainder of the second web. The web secured to the inner periphery of the flange is preferably more permeable to oxygen than the second web such that, upon removal of the second web, the packaged meat product will bloom to a red color.

In accordance with another aspect of the invention, a packaging apparatus is provided, comprising:

a. a tray carrier for holding a tray having an outwardly extending flange around substantially the entire perimeter of the tray;

b. a mechanism for positioning a web of material over the tray;

c. a device for securing a portion of the web to an inner periphery of the tray flange to substantially completely enclose a product between the tray and the secured web portion;

d. an apparatus for elevating a portion of the web, the elevated web portion being located adjacent the secured web portion such that the elevated portion is positioned above an outer periphery of the flange; and e. a device for severing the web at the elevated portion, thereby separating the secured web portion from the remainder of the web.

The method and apparatus of the present invention allows a product to be packaged in a dual-lid package having simple tray-flange configuration, e.g., a conventional single flange, and provides a reliable way of severing the permeable web without causing damage to the outer periphery of the flange.

DETAILED DESCRIPTION OF THE INVENTION

Figure 1:
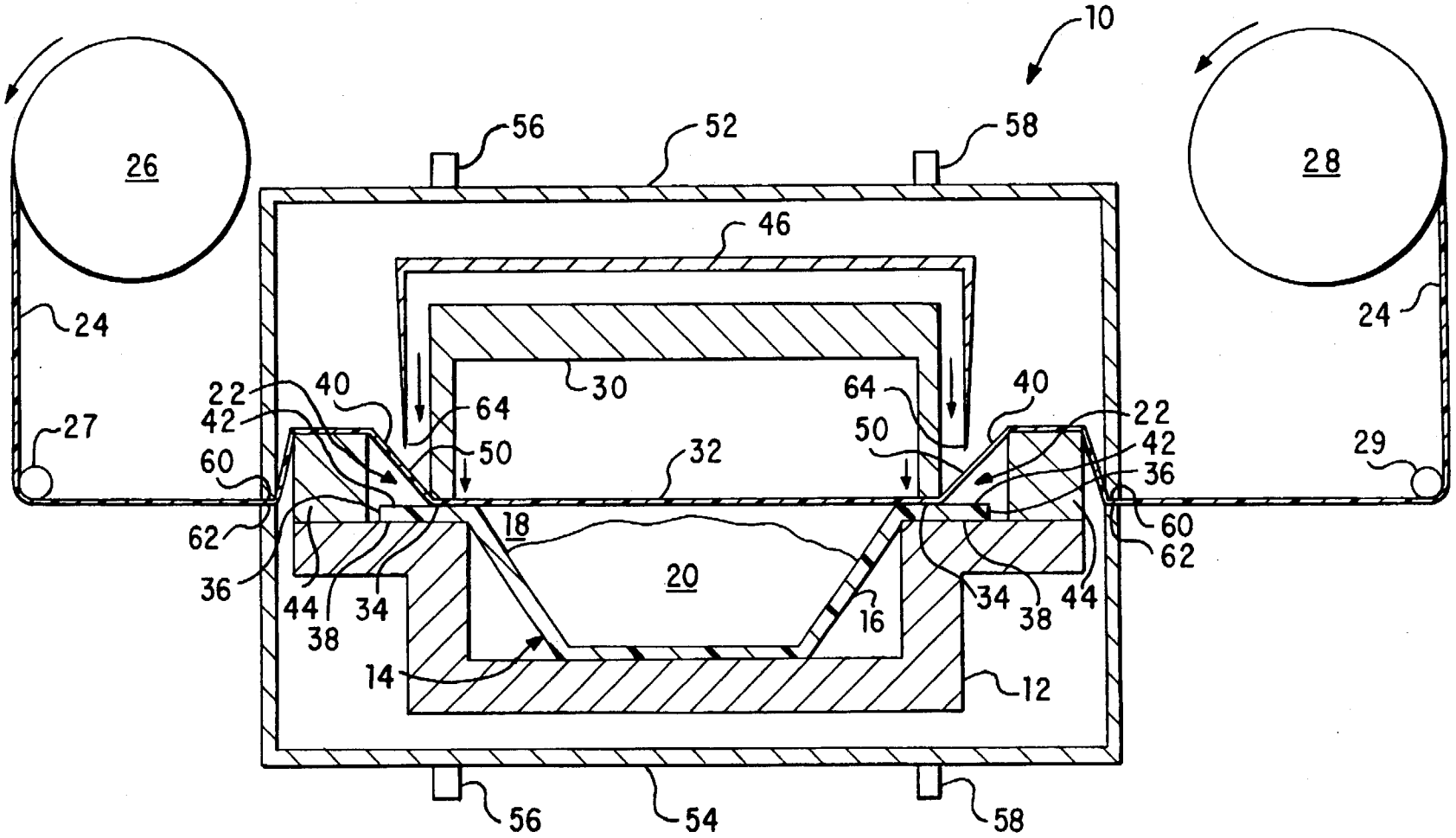
FIG. 1 is a schematic, cross-sectional view of one embodiment of an apparatus and method for packaging a product in accordance with the present invention.

Referring now to FIG. 1, a packaging apparatus 10 in accordance with the present invention is shown. Apparatus 10 includes a tray carrier 12 for holding and transporting tray 14 throughout the packaging operation to be described herein. Tray 14 includes a base 16 which defines a cavity 18 for receiving and containing a food product 20. Tray 14 further includes an outwardly extending flange 22 around substantially the entire perimeter of the base 16. Tray 14 can have any desired configuration or shape, e.g., rectangular, round, oval, etc. Similarly, flange 22 may have any desired shape or design, including a simple, substantially flat design which presents a single sealing surface as shown, or a more elaborate design which presents two or more sealing surfaces, such as the aforedescribed flange configurations disclosed in U.S. Pat. Nos. 5,348,752 and 5,439,132, the disclosures of which are hereby incorporated herein by reference.

Suitable materials from which tray 14 can be formed include, without limitation, polyvinyl chloride, polyethylene terephthalate, polystyrene, polyolefins such as high density polyethylene or polypropylene, paper pulp, nylon, polyurethane etc. Tray 14 may be foamed or non-foamed as desired, and preferably provides a barrier to the passage of oxygen therethrough, particularly when food product 20 is perishable or degradable in the presence of oxygen, such as fresh red meat products (e.g., beef, veal, lamb, pork, etc.), poultry, fish, cheese, fruits, or vegetables. Tray 14 preferably allows less than or equal to about 500 cc of oxygen to pass, more preferably less than about 100 cc of oxygen, more preferably still less than about 50 cc, and most preferably less than about 25 cc of oxygen to pass per square meter of material per 24 hour period at 1 atmosphere and at a temperature of 73° F.

Tray 14 may be formed from a material which provides a barrier to the passage of oxygen, e.g., vinylidene chloride copolymer, nylon, polyethylene terephthalate, ethylene/vinyl alcohol copolymer, etc. Alternatively, tray 14 may have an oxygen-barrier film laminated or otherwise attached to the inner or outer surface thereof, as disclosed in U.S. Pat. Nos. 4,847,148 and 4,935,089, and in U.S. Ser. No. 08/326,176, filed Oct. 19, 1994 and entitled "Film/Substrate Composite Material," the disclosures of which are hereby incorporated herein by reference. The laminated film preferably includes an oxygen-barrier material such as e.g., vinylidene chloride copolymer, nylon, polyethylene terephthalate, ethylene/vinyl alcohol copolymer, etc.

Although the present invention is described in connection with a food product 20 having a maximum height which is below the maximum height of tray 14, i.e., the level at which flange 22 is located, the invention is not limited to such "low profile" food products. The method and apparatus of the present invention may also be used to package "high profile" food products, i.e., those having a maximum height which is above the level at which flange 22 is located so that the product will be in contact with the lid which is attached to the flange.

Apparatus 10 further includes a mechanism for positioning a web of material 24 over tray 14. In the embodiment illustrated in FIG. 1, the positioning mechanism is provided by rolls 26 and 28 which unwind and take-up, respectfully, web 24, and guide rolls 27 and 29 which guide the web into position over tray 14 as shown. The material from which web 24 is formed is preferably a flexible, polymeric film.

Apparatus 10 also includes a device 30 for securing a portion 32 of web 24 to an inner periphery 34 of flange 22, thereby enclosing product 20 between tray 14 and the secured web portion 32. The term "inner periphery" simply refers to a circumferential area of the upper surface of flange 22 to which a portion of web 24 is secured such that a circumferential area outboard of the inner periphery, i.e., an area between the inner periphery 34 and the outer edge 36 of flange 22, remains on the upper surface of flange 22. Such area of flange 22 outboard of the inner periphery 34 is herein referred to as an "outer periphery" of the flange.

Securing device 30 is preferably a heated element which applies heat and pressure to web 24 at inner periphery 34 as shown, thereby heat-sealing web portion 32 to inner periphery 34 of flange 22. In this regard, the materials from which web 24 and the upper surface of flange 22 are formed are preferably selected such that a heat-seal can be effected between the two materials when sufficient heat and pressure are applied to web 24 and inner periphery 34 by securing device 30. Ledge 38 of tray carrier 12 supports flange 22 during the securing/sealing operation by providing the flange with a firm backing to oppose the pressure which securing device 30 applies to the flange.

An important feature of the present invention is the provision of an apparatus for elevating, i.e., lifting or raising, a portion 40 of web 24. The elevated web portion 40 is located adjacent the secured web portion 32 such that the elevated portion 40 is positioned above an outer periphery 42 of flange 22. In the embodiment shown in FIG. 1, such elevating apparatus includes support member 44 which supports the elevated web portion 40 above outer periphery 42 of flange 22. Support member 44 is affixed to tray carrier 12 and spaces the elevated web portion 40 sufficiently from the outer periphery 42 of flange 22 that the web can be severed without damaging the flange.

Although FIG. 1 illustrates a particular type of elevating apparatus, namely support member 44 which is affixed to tray carrier 12, various alternatives are possible, provided that any such alternative elevating apparatus can also space the elevated web portion 40 sufficiently from the outer periphery of the flange that the web can be severed without damaging the flange. Suitable alternatives will be discussed below in connection with FIGS. 2 and 3.

Apparatus 10 further includes a device 46 for severing web 24 at the elevated portion 40 thereof, thereby separating the secured web portion 32 from the remainder of web 24 to form a lid on tray 12. Severing device 46 can be any conventional cutting device but preferably comprises a heated cutting element such as a heated wire or heated blade. Particularly when it is desired to add a second web to tray 14 (e.g., a relatively oxygen-impermeable film), it is also preferred that web 24 be formed from a heat-shrinkable material. In this manner, when the elevated web portion 40 is severed, the portion of the web between the inner periphery 34 and the circumference 50 at which the web is severed will shrink back towards the inner periphery 34, thereby exposing the outer periphery 42 of flange 22 for subsequent application of a second web to tray 14. Alternatively, where severing device 46 is unheated and web 24 is formed from a heat-shrinkable material, the portion of the web between the secured portion 32 and the severed circumference 50 can be caused to shrink by exposing the portion 32 to heat, e.g., heated air or heated water, after secured portion 32 has been severed from the remainder of the web 24.

It is to be understood, however, that it is not necessary for web 24 to be heat-shrinkable. Rather, severed circumference 50 can simply be made close enough to secured web portion 32 such that a sufficient outer periphery 42 of flange 22 is exposed for attachment of a second web. Furthermore, if a second web will not be applied to the outer periphery of the flange, it would also be unnecessary for web 24 to be heat-shrinkable. However, it is preferred that web 24 be heat-shrinkable and that severing device 46 be a heated cutting element inasmuch as this arrangement facilitates an automated, continuous packaging operation.

Both securing device 30 and severing device 46 can have any desired shape but preferably have a closed ring shape (when viewed from above). More preferably, devices 30 and 46 have a closed ring shape which is substantially similar to the shape of flange 22.

In a preferred embodiment, apparatus 10 includes a mechanism for at least partially evacuating tray 14 of air and then at least partially filling the tray with a gas which is lower in oxygen content than air, i.e., "back-flushing." As illustrated in FIG. 1, such a mechanism includes upper vacuum chamber 52, lower vacuum chamber 54, vacuum ports 56, and back-flush ports 58. At a desired point in the process, upper and lower chambers 52 and 54 are joined to form a substantially air-tight enclosure by bringing respective edges 60 and 62 together as shown. An incidental result of closing chambers 52 and 54 in this manner is that part of web 24 will be pinched between edges 60 and 62 of chambers 52 and 54 as shown.

After the chamber has been closed, a desired vacuum is drawn through ports 56, and then a desired gas or mixture of gases is introduced into the resultant enclosure through ports 58. Any desired amount of air may be removed from the enclosure during the evacuation step, e.g., ranging from 1% to 99.999% by volume. More typically, the amount of air removed will range from about 99% to about 99.999%, and most typically from about 99.5% to about 99.99%. Preferred gases to be back-flushed through ports 58 include carbon dioxide, inert gases such as nitrogen or argon, and mixtures of such gases. As a result of evacuation and back-flushing, the cavity 18 of tray 14, as lidded, will preferably have less than 1% oxygen by volume, more preferably less than 0.1% oxygen, and most preferably, less than 0.05% oxygen by volume, with the balance comprising a gas or mixture of gases, such as a mixture of carbon dioxide and nitrogen.

Having described packaging apparatus 10, a preferred method of using that apparatus to package a product in accordance with the present invention will be explained. Tray 14 is first loaded onto tray carrier 12 and food product 20 is loaded into the cavity 18 of tray 14 by any conventional manner. Rolls 26 and 28, in conjunction with guide rolls 27 and 29, then position film web 24 over tray 14 so that a portion of the web can be secured to flange 22. Specifically, securing device 30 secures portion 32 of web 24 to inner periphery 34 of flange 22 to substantially completely enclose food product 20 between tray 14 and the secured portion 32 the web. Securing device 30 is vertically movable, and moves downwards, as indicated by the arrows in FIG. 1, until it comes in contact with inner periphery 34 in order to effect the securing operation. After the portion 32 of web 24 has been secured to flange 22 and severed from the rest of the web, securing device 30 moves upwards, i.e., away from flange 22, to allow the lidded tray 14 to be moved to another stage of the packaging operation and to allow another product-loaded tray to take the place of tray 14.

Either during, immediately before, or immediately after the aforedescribed securing step takes place, a portion 40 of web 24 is elevated above the outer periphery 42 of flange 22 by support member 44. As shown, the elevated web portion 40 is located immediately adjacent the secured portion 32. The elevated web portion 40 is then severed at 50 by severing device 46, thereby separating the secured web portion 32 from the remainder of web 24. Severing device 46 is vertically movable, and moves downwards, as indicated by the arrows in FIG. 1, until it comes in contact with the elevated web portion at 50 in order to effect the severing operation. Thereafter, severing device 46 retracts to the starting position shown in FIG. 1. The secured and separated web portion 32 then becomes a lid for tray 14, thereby fully enclosing food product 20. Although FIG. 1 shows web 24 being severed above flange 22, it could, if desired, be severed outboard of outer edge 36 of flange 22. More preferably, however, the web is severed above the flange in order to leave room on the outer periphery of the flange for securing a second web or lid to the tray.

Significantly, support member 44 elevates the web portion 40 prior to the step of severing the web. In this manner, it is a relatively simple matter to avoid damaging flange 22 while severing the web. This is accomplished by spacing elevated web portion 40 sufficiently from the outer periphery 42 of flange 22 that the end 64 of severing device 46 will not come in contact with or otherwise damage the flange while the web is being severed. Spacing of elevated web portion 40 above outer flange periphery 42 is determined by the height of support member 44 above ledge 38 of tray carrier 12, and also the distance between support member 44 and inner periphery 34. The extent to which web portion 40 must be spaced from outer flange periphery 42 is dependent upon a number of factors, including:

1. the maximum downward travel and tolerance of severing device 46 as it moves through each cycle;

2. the degree to which web 24 will flex as it is being severed; and 3. whether severing device 46 is a heated element which severs the web by burning an opening therethrough at 50; in this case, severing device 46 can damage flange 22 even though end 64 does not contact flange 22 by, e.g., burning, scorching, or melting the flange when end 64 comes too close to the flange, thereby necessitating more spacing between elevated web portion 40 and outer flange periphery 42 than if severing device 46 is not heated, e.g., a sharpened cutting instrument.

As noted above, web 24 is preferably heat-shrinkable and the secured and severed portion 32, i.e., the lid, is preferably heated sufficiently to cause the portion between the inner periphery 34 and the circumference 50 at which the web is severed to shrink back towards the inner periphery 34, thereby exposing the outer periphery 42 of flange 22 for subsequent application of a second web to tray 14. Heating may be accomplished by a variety of methods. For example, subsequent to the packaging operation illustrated in FIG. 1, the lidded tray 14 with product 20 therein may be conveyed through a shrink tunnel and subjected to hot air or, less preferably, hot water at a temperature sufficiently high to produce a desired amount of shrinking. More preferably, severing device 46 is a heated element, e.g., a thermal cutting device such as a hot wire or heated knife, that upon severing the web applies sufficient heat to shrink the portion of the web outside of inner periphery 34.

Preferably the method includes, prior to securing web 24 to flange 22, the step of at least partially evacuating tray 14 of air and then at least partially filling the tray with a gas which is lower in oxygen content than air. This is accomplished by joining upper and lower chambers 52 and 54 to form a substantially air-tight enclosure as shown in FIG. 1. A desired vacuum is then drawn through ports 56 and a desired gas or mixture of gases is introduced into the enclosure through ports 58 as described above. Thereafter, the aforedescribed steps of securing, elevating, and severing the web are carried out. In this manner, food product 20 can be shipped and stored in an atmosphere which is ideally suited to maximize the shelf-life of that particular product.

The method in accordance with the present invention is preferably a continuous process, with one product-containing tray after another having a lid applied thereto in the manner described above. Rolls 26 and 28 continuously unwind and take-up, respectively, web 24 through each such packaging cycle to continuously present a new section of web from which a portion may be secured and severed. Guide rolls 27 and 29 hold web 24 in position over tray 14 during the securing/severing process, and then rolls 26 and 28 advance the web while a new product-containing tray is being moved into the position shown in FIG. 1.

Figure 2:
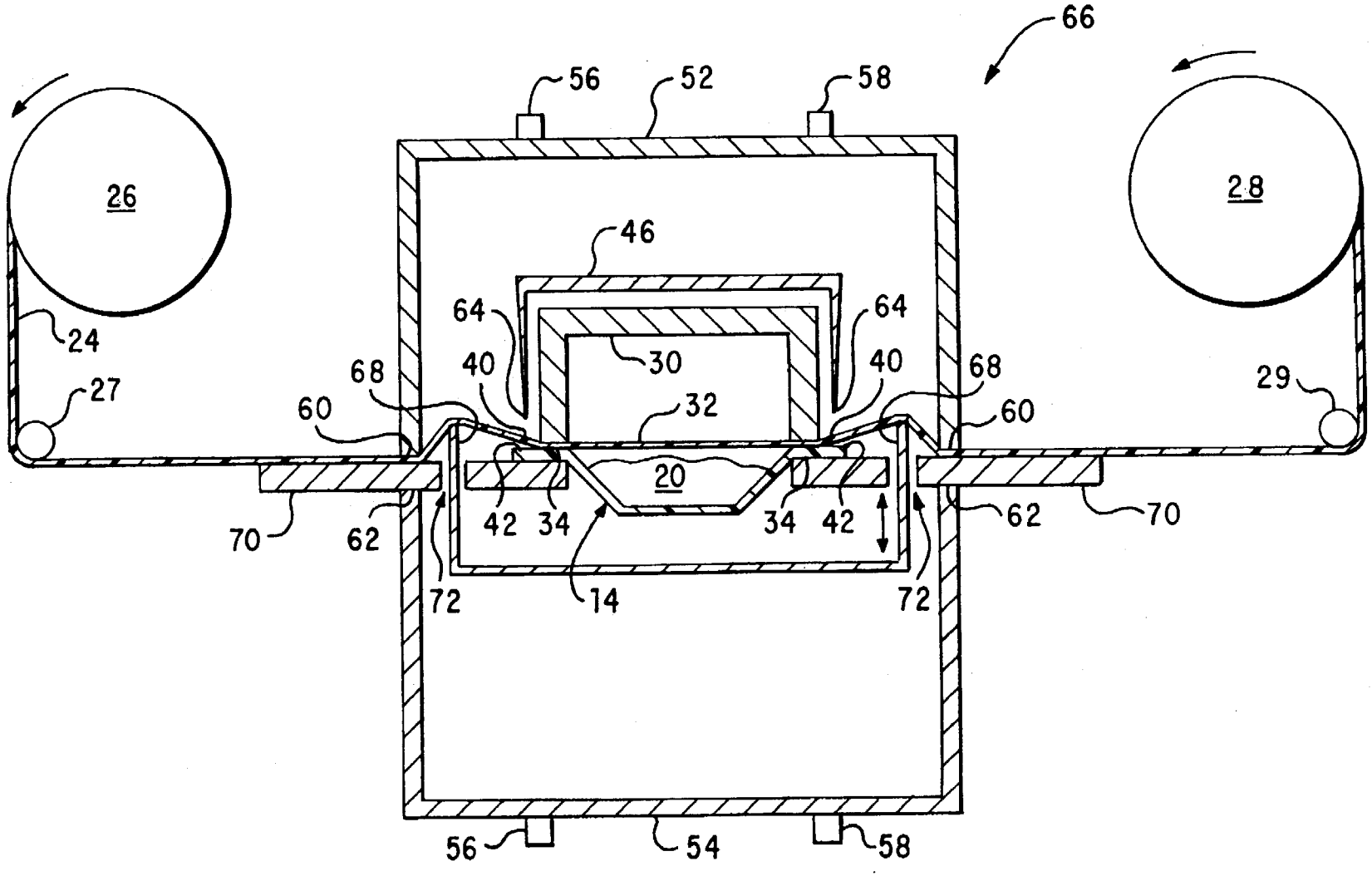
FIG. 2 is a schematic, cross-sectional view of another embodiment of an apparatus and method for packaging a product in accordance with the present invention.

Referring now to FIG. 2, where components which are identical to those depicted in FIG. 1 have been given the same reference numerals, an alternative apparatus for elevating the web will be described. In packaging apparatus 66, the elevating apparatus comprises a movable support member 68 which supports elevated web portion 40 above the outer flange periphery. 42 of tray 14. Tray carrier 70 is adapted to receive the movable support member 68 via openings 72. Support member 68 is movable in the direction shown by the arrows in FIG. 2 and can be moved upwards through openings 72 to elevate portion 40 of web 24, as shown in FIG. 2, at any desired point in the packaging process. Such a point preferably occurs just prior to the severing of web 24 by severing device 46. Movable support member 68 serves the same function as fixed support member 44, namely, spacing elevated web portion 40 sufficiently from the outer periphery 42 of flange 22 that the end 64 of severing device 46 will not come in contact with or otherwise damage the flange while the web is being severed. After the web has been severed, movable support member 68 retracts to a position (not shown) which is below tray carrier 70 so that the tray carrier and lidded tray 14 can be conveyed to a further stage in the packaging process.

As shown in FIG. 2, upper and lower vacuum chambers 52 and 54 have closed to form a substantially air-tight enclosure to facilitate evacuation and/or back-flushing as described above. Tray carrier 70 extends outside of the enclosure so that edges 60 and 62 of respective chambers 52 and 54 pinch both the tray carrier and web 24 therebetween when the vacuum chamber is closed.

If desired, apparatus 66 could be altered to allow lower vacuum chamber 54 to perform the function of, and thereby supplant, movable support member 68. This may be accomplished by adapting tray carrier 70 to allow edge 62 of lower vacuum chamber 54 to extend upwards therethrough sufficiently to elevate web portion 40 above outer flange periphery 42 when the vacuum chamber is closed.

Figure 3:
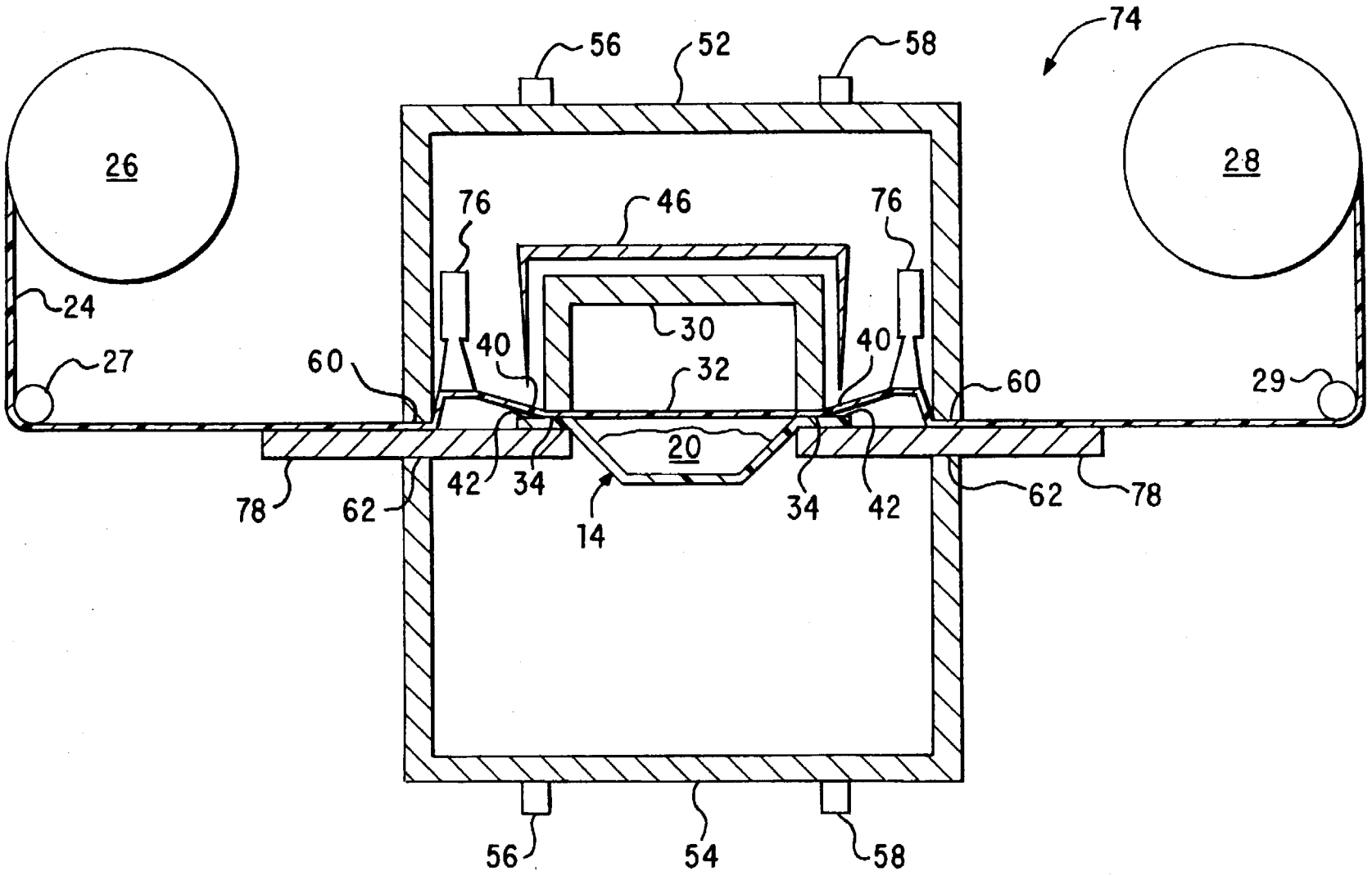
FIG. 3 is a schematic, cross-sectional view of yet another embodiment of an apparatus and method for packaging a product in accordance with the present invention.

Referring now to FIG. 3, where components which are identical to those depicted in FIG. 1 have been given the same reference numerals, another alternative apparatus for elevating the web will be described. Packaging apparatus 74 includes, as an elevating apparatus, a vacuum mechanism 76, e.g., suction cups, for pulling elevated web portion 40 above the outer flange periphery 42 of tray 14, which is held by tray carrier 78. As an alternative to using suction cups, a pressure differential between upper and lower vacuum chambers 52 and 54 could be employed to elevate the web. In this instance, after upper and lower vacuum chambers 52 and 54 close, the pressure in upper chamber 52 is made sufficiently lower than that in lower chamber 54 to elevate, via the higher pressure under the web than above, the portion 40 of web 24 above the outer periphery 42 of flange 22.

Figure 4:
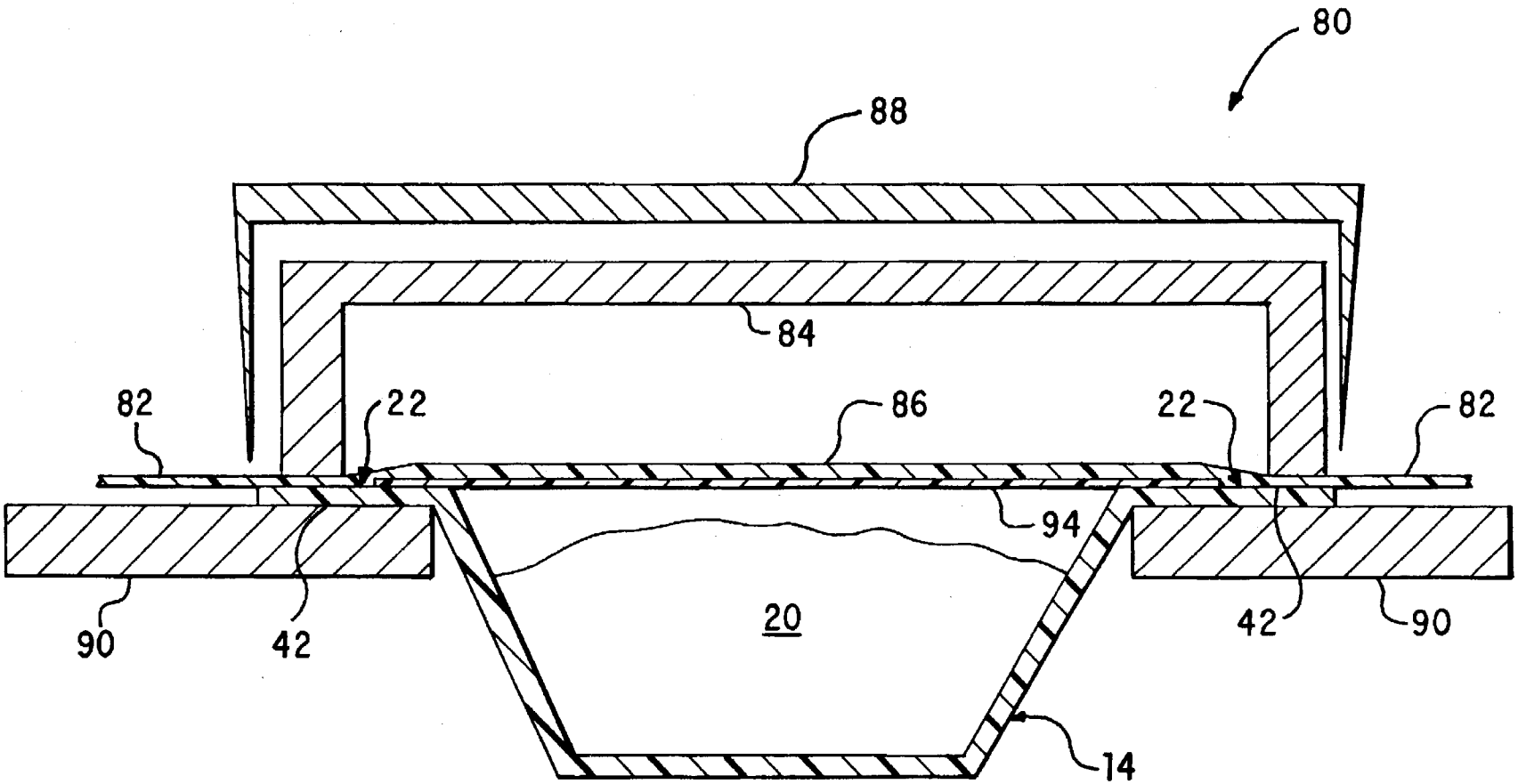
FIG. 4 is a schematic, cross-sectional view of an apparatus and method for applying a second lid to a packaged product made in accordance with FIGS. 1, 2, or 3.

As with the embodiment shown in FIG. 2, upper and lower vacuum chambers 52 and 54 in FIG. 3 have closed to form a substantially airtight enclosure. Tray carrier 78 extends outside of the enclosure so that edges 60 and 62 of respective chambers 52 and 54 pinch both the tray carrier and web 24 therebetween when the vacuum chamber is closed. Referring now to FIG. 4, an apparatus 80 for applying a second lid to tray 14 will be described. Apparatus 80 includes a mechanism (not shown) for positioning a second web of material 82 over tray 14, a device 84 for securing a portion 86 of second web 82 to outer periphery 42 of flange 22, and a device 88 for severing secured web portion 86 from the remainder of second web 82. The positioning mechanism may be similar to the positioning mechanisms shown in FIGS. 1–3, and preferably includes a pair of rolls (not shown) which unwind and take-up, respectfully, second web 82, along with a pair of guide rolls (not shown) which position the web over tray 14. Securing device 84 and severing device 88 are preferably similar to securing device 30 and severing device 46, respectively, as described above.

After tray 14 has had a first lid 94 applied thereto from web 24 as described above (either by apparatus 10, 66, or 74), the lidded tray is transported by tray carrier 90 to apparatus 80. Tray carrier 90 may be the same tray carrier in which tray 14 had lid 94 applied thereto (i.e., either tray carrier 12, 70, or 78), or it could be a different tray carrier. At apparatus 80, second web 82 is positioned over tray 14 and portion 86 thereof is secured to the outer flange periphery 42. The secured portion 86 is then severed from the remainder of second web 82 to thereby form a second lid on tray 14.

Figure 5:
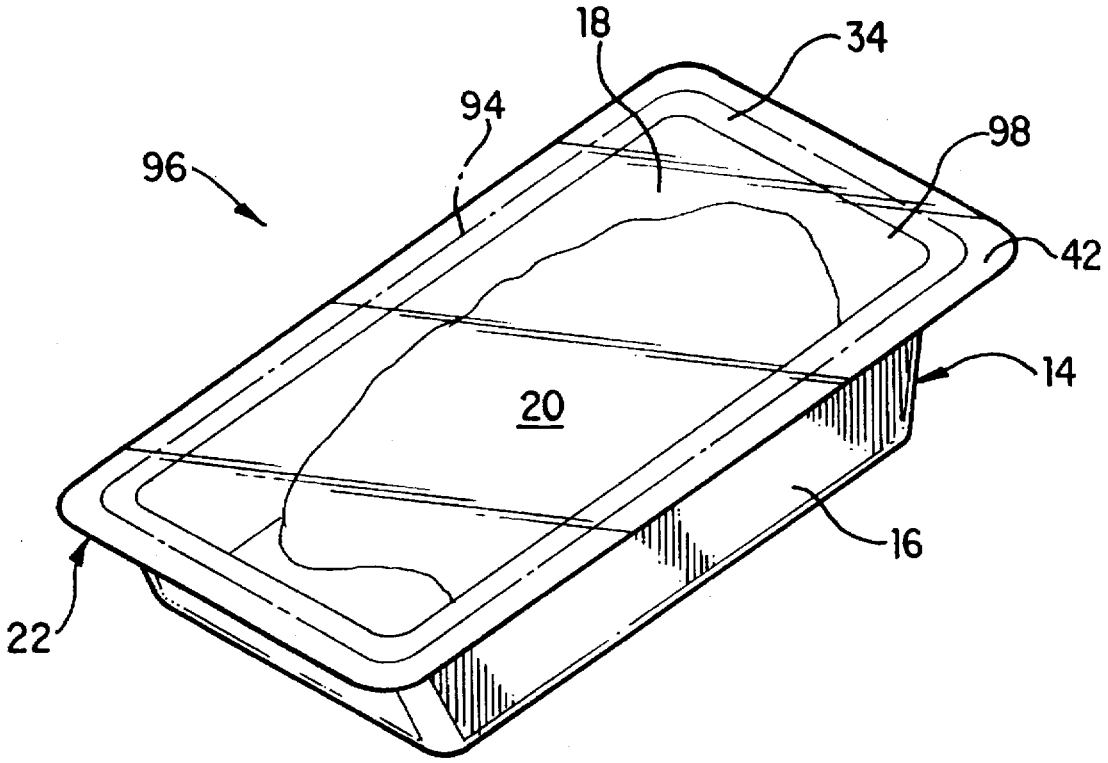
FIG. 5 is a perspective view of a dual-lid package made in accordance with the present invention.

Referring now to FIG. 5, a dual lid package 96 prepared in accordance with the aforedescribed methods and apparatus of the present invention will be described. Upper lid 98, severed from second web 82 as secured web portion 86, is secured to outer periphery. 42 of flange 22 of tray 14. Lid 94 (shown in phantom and severed from web 24) is secured to inner flange periphery 34 and is positioned beneath lid 98 on flange 22. Food product 20 is thus enclosed within tray 14 by lids 94 (located closest to product 20) and 98.

Lid 94, i.e., web 24, is preferably formed from a material which is more permeable to oxygen than the material from which is formed lid 98, i.e., second web 82. More preferably, web 24 is formed from a relatively oxygen-permeable material while second web 82 is formed from a relatively oxygen-impermeable material.

Web 24 is preferably a film which may be thermoformable or, more preferably, stretchable, e.g., stretch-oriented and heat-shrinkable, and may be formed from any material having sufficient oxygen permeability (as described below) and which may be securely sealed and bonded to flange 22 of tray 14. Examples include such materials as, e.g., ethylene/vinyl acetate copolymer (EVA), ethylene/butyl acrylate copolymer, polyethylene homopolymer and copolymers such as ethylene/alpha-olefin copolymers, ionomers, etc. The ethylene/alpha-olefin copolymer may be either heterogeneous or homogeneous. That is, ethylene/alpha-olefins formed by conventional Zeigler-Natta catalysis are heterogeneous copolymers such as, e.g., linear low density polyethylene (LLDPE), whereas single-site catalyzed copolymers such as those formed via metallocene catalyst technology are homogeneous in nature, all of which are within the scope of the invention. Further, web 24 may be a single or multilayer film having other layers for other desired purposes such as, e.g., abuse-resistance, heat-sealability, optical properties, strength, improved oxygen-permeability, etc. In the case of a multilayer film, any suitable technique for making film may be employed such as, e.g., coextrusion, lamination, extrusion coating, etc. An exemplary film structure for web 24 is EVA/LLDPE/EVA/LLDPE/EVA. Such film is preferably coextruded and stretch-oriented. The film may also be crosslinked through electronic or chemical means.

When food product 20 is a fresh red meat product, web 24 preferably admits at least about 1,000 cc of gas (oxygen) per square meter of the material per 24 hour period at 1 atm. and at a temperature of 73° F. More preferably, web 24 admits at least 5,000, even more preferably at least 10,000, and most preferably at least 100,000 cc of oxygen per square meter of the material per 24 hour period at 1 atm. and at a temperature of 73° F. This oxygen permeability is desirable so that, when second lid 98 (formed from second web 82) is peeled, oxygen can quickly permeate lid 94 and oxygenate the fresh red meat product to provide the desirable bright red "bloom" associated by the consumer with freshness.

In addition to or instead of being inherently permeable as described above, web 24 can be perforated with very small holes and/or can have one or more larger holes over which is applied a "patch" of a material which has a very high degree of permeability to the passage of oxygen (e.g., a microporous material such as spun-bonded polyolefin or polyester materials, e.g., Tyvek™ from DuPont). The number and/or size of such holes can be selected to achieve any desired level of oxygen permeability.

Second web 82 may be any suitable coextruded or laminate film which is substantially impermeable to oxygen (as described below) so that a fresh red meat product contained in a vacuum or low oxygen atmosphere in package 96 possesses an enhanced shelf-life over a package without an oxygen-impermeable lid. Web 82 may be thermoformable or stretch-oriented, and may likewise be a single or multi-layer film having other layers for other purposes as desired.

Second web 82 is preferably substantially impermeable to gas, especially oxygen, and preferably allows less than or equal to about 500 cc of oxygen to pass, more preferably less than about 100 cc of oxygen, more preferably still less than about 50 cc, and most preferably less than about 25 cc of oxygen to pass per square meter of material per 24 hour period at 1 atmosphere and at a temperature of 73° F.

Suitable materials from which second web 82 may be formed include one or more layers of, e.g., ethylene/vinyl alcohol copolymer (EVOH), vinylidene chloride copolymer (saran), polyesters and copolyesters, polyamides and copolyamides, polyvinyl alcohol, polyhydroxyaminoether, polyalkylene carbonate, blends of the foregoing materials, and other oxygen-barrier materials which are well known in the art. An exemplary film structure for second web 82 is polyamide/tie/polyamide/EVOH/polyamide/tie/LLDPE/LLDPE and/or EVA (where "tie" is a tie or adhesive layer). Such film is preferably cast-coextruded. An alternative film structure is a saran-coated, biaxially-oriented polyamide film adhesively laminated to the following coextruded film: EVA/LLDPE/PE and/or PP and/or EVA.

Although the presently described embodiments pertain to dual-lid food packaging, it should be apparent that the teachings of the present invention are readily applicable to any apparatus or method wherein it is desirable to apply a flexible lid to a tray.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method for packaging a product, comprising:

a. providing a tray with a product therein, said tray having an outwardly extending flange around substantially the entire perimeter of said tray;

b. positioning a web of material over said tray and securing a portion of said web to an inner periphery of said flange to substantially completely enclose said product between said tray and the secured portion of said web;

c. elevating a portion of said web, said elevated portion being located adjacent said secured portion such that said elevated portion is positioned above an outer periphery of said flange; and d. severing said web at said elevated portion above said outer periphery of said flange, thereby separating said secured portion from the remainder of said web.

2. The method of claim 1, wherein said web is heat-shrinkable and is heated sufficiently to cause said web to shrink.

3. The method of claim 1, wherein said elevated portion of said web is spaced sufficiently from the outer periphery of said flange that said web can be severed without damaging said flange.

4. The method of claim 1, further including the steps of:

positioning a second web of material over said tray and securing a portion of said second web to the outer periphery of said flange; and severing said secured portion of said second web from the remainder of said second web.

5. The method of claim 4, wherein said web secured to the inner periphery of said flange is more permeable to oxygen than said second web.

6. The method of claim 1, further including, prior to securing said web to said flange, the step of at least partially evacuating said tray of air and then at least partially filling said tray with a gas which is lower in oxygen content than air.

7. The method of claim 1, wherein said tray is held in a tray carrier, said tray carrier including a support member which supports the elevated portion of said web above the outer periphery of said flange.

8. The method of claim 1, wherein said tray is held in a tray carrier, said tray carrier adapted to receive a movable support member which supports the elevated portion of said web above the outer periphery of said flange.

9. The method of claim 1, wherein said web is elevated by pulling said elevated portion above the outer periphery of said flange.

10. A packaging apparatus, comprising:

a. a tray carrier for holding a tray having an outwardly extending flange around substantially the entire perimeter of said tray;

b. a mechanism for positioning a web of material over said tray;

c. a device for securing a portion of said web to an inner periphery of said tray flange to substantially completely enclose a product between said tray and the secured web portion;

d. an apparatus for elevating a portion of said web, said elevated web portion being located adjacent said secured web portion such that said elevated portion is positioned above an outer periphery of said flange; and e. a device for severing said web at said elevated portion above said outer periphery of said flange, thereby separating said secured web portion from the remainder of said web.

11. The apparatus of claim 10, wherein said web is heat-shrinkable and said apparatus further includes means for heating said web sufficiently to cause said web to shrink.

12. The apparatus of claim 10, wherein said elevating apparatus spaces said elevated web portion sufficiently from the outer periphery of said flange that said web can be severed by said severing device without damaging said flange.

13. The apparatus of claim 11, further including:

a mechanism for positioning a second web of material over said tray;

a device for securing a portion of said second web to the outer periphery of said flange; and a device for severing said secured portion of said second web from the remainder of said second web.

14. The apparatus of claim 13, wherein said web secured to the inner periphery of said flange is more permeable to oxygen than said second web.

15. The apparatus of claim 10, further including a mechanism for at least partially evacuating said tray of air and then at least partially filling said tray with a gas which is lower in oxygen content than air.

16. The apparatus of claim 10, wherein said elevating apparatus comprises a support member which supports said elevated web portion above the outer periphery of said flange, said support member being affixed to said tray carrier.

17. The apparatus of claim 10, wherein said elevating apparatus comprises a movable support member which supports said elevated web portion above the outer periphery of said flange, said tray carrier being adapted to receive said support member.

18. The apparatus of claim 10, wherein said elevating apparatus comprises a vacuum mechanism for pulling said elevated web portion above the outer periphery of said flange.

* * * * *